United States Patent [19]

Torre et al.

[11] 4,137,480

[45] Jan. 30, 1979

[54] TELEVISION PICTURE TUBE WITH CATHODE COATING EROSION SUPPRESSION

[75] Inventors: Alton J. Torre, Wheaton; Michael W. Retsky, Chicago; Norman F. Gioia, Lombard; Ramesh G. Amin, Itaska, all of Ill.

[73] Assignee: Zenith Radio Corporation, Glenview, Ill.

[21] Appl. No.: 784,478

[22] Filed: Mar. 31, 1977

[51] Int. Cl.[2] ..... H01J 29/94; H01J 9/385

[52] U.S. Cl. ..... 313/481; 313/458; 313/412; 316/18

[58] Field of Search ..... 313/481, 412, 458, 460, 313/414, 409, 411, 413, 417, 424

[56] References Cited

U.S. PATENT DOCUMENTS

| | | | |
|---|---|---|---|
| 2,617,061 | 11/1952 | De Gier | 313/424 X |
| 3,604,969 | 9/1971 | Blumenberg | 313/458 X |
| 3,614,502 | 10/1971 | Doggett et al. | 313/412 |

*Primary Examiner*—Robert Segal
*Attorney, Agent, or Firm*—Ralph E. Clarke, Jr.

[57] ABSTRACT

This disclosure depicts a novel electron gun having at least one cathode having an electron emissive coating, a forward element and a plurality of electrodes interspaced between the cathode and the forward element. The electrodes and forward element each have at least one aperture wherein the apertures in the electrodes and forward element are coaxial and define at least one beam passageway for passing through the gun a stream of electrons emitted by the cathode during operation. The beam passageway unavoidably forms a conduit for high velocity gas when the gun is located in a narrow neck of a television picture tube and the tube is evacuated of gas through a tubulator located at the rear end of the neck. The improvements in the electron gun comprise a gas influencing element for reducing and perturbing the high velocity gas flow in the conduit at least in the region of the cathode as the tube is evacuated to suppress erosion of the cathode coating by preventing a violent flow of gas over the cathode.

13 Claims, 15 Drawing Figures

TELEVISION PICTURE TUBE WITH CATHODE COATING EROSION SUPPRESSION

CROSS REFERENCE TO RELATED APPLICATION

This application relates to, but is in no way dependent upon, copending applications of common ownership herewith, including: Ser. No. 782,140 filed Mar. 28, 1977 and Ser. No. 649,630, filed Jan. 16, 1976 and Ser. No. 642,049, filed Dec. 18, 1975, now U.S. Pat. No. 4,032,811, issued Jun. 28, 1977.

BACKGROUND OF THE INVENTION

This invention relates in general to the manufacture of color television picture tubes and in particular to an apparatus for suppressing erosion of the electron emissive coating on the cathode of an electron gun during manufacture of the tube. Conventionally, an electron gun used in a color television picture tube includes an electron beam source and an electron beam focus lens. The electron beam source typically comprises a heated cathode element and associated electrodes which collect electrons emitted by the cathode element and form them into a beam cross-over. The electron beam focus lens shapes the stream of electrons emitted by the cathode and focuses the beam cross-over on the screen of the tube. The electron beam focus lens typically comprises electrodes at varying potentials. The forward element is the focus lens anode and typically takes the form of a cup called a "convergence" or "shield" cup.

An electron gun for use in a color television picture tube generally comprises three guns, one each for exciting red, blue and green phosphor elements on the screen of the tube. Each of the electrodes and the shield cup in the gun have three apertures, one for each of the three cathodes which emit the streams of electrons. The apertures are generally circular and the apertures for each beam lie on a common line, that is they are coaxial. The apertures in the electron gun form beam passageways.

An electron gun which is used in a black and white television picture tube has only one aperture in each of the electrodes and convergence cup or shield cup. Thus there is only one stream of electrons emitted by the gun. Like the color television picture tube gun the apertures in the electrodes of the black and white gun also are coaxial.

In the manufacture of color televison pictue tubes or black and white picture tubes, after the tube is assembled, most of the gas, usually air, which is inside the tube must be evacuated. Conventionally, this is done by attaching a vacuum pump to a tubulator which is located at the rear of the neck of the tube. As the tube is evacuated, all of the gas which is drawn from the tube must move through the neck of the tube and thus through the electron gun situated in the tube neck. The beam passageways through the gun unavoidably act as high velocity gas conduits as the tube is evacuated. These high velocity gas conduits create a violent flow of gas over the cathodes while the tube is being evacuated. It has been observed that this violent flow of gas over the cathode causes erosion of the electron emissive coating on the cathode (especially the coating of the "green" cathode in an electron gun for a color television pictue tube) which may necessitate rejection of a tube or which may result in degraded performance and/or reliability of a tube.

It is common practice in the manufacture of television pictue tubes to control the humidity during evacuation of the tube within a narrow dew point window. Typically the dew point is controlled between 40° F to 50° F. If the humidity is too high the cathode coating is eroded by particles of moisture during evacuation. It is believed that the moisture particles actually freeze during pump down. This, coupled with the high velocity at the initiation of evacuation and the violent flow of the air through the electron gun in the neck of the tube results in serious erosion of the cathode coating. The narrow dew point window has always presented serious problems in the manufacture of color television picture tubes. The conventional factory process must be constantly and closely monitored and the dew point window shifted with the seasons of the year. The present process is so difficult as to be barely workable. Suppression of the cathode erosion would allow the dew point window to be opened up, and thus allow the same process to be used year around.

Copending application Ser. No. 782, 140 filed Mar. 28, 1977 method of preventing cathode coating erosion wherein gas is pumped slowly from the tube so that the flow of gas through the electron gun does not occur at such a high rate as to cause erosion of the cathode coatings. This method has several drawbacks: (1) an undesirably long time is needed to evacuate the tube, and (2) also the method is not totally reliable.

This invention has general applicability and may be applied to electron gun assemblies in color television tubes as well as to electron guns in black and white tubes. The invention is known to have applicability to a televison picture tube having a narrow neck utilizing either a standard type electron gun or a unique type of electron gun disclosed in U.S. Pat. No. 3,995,194.

OBJECTS OF THE INVENTION

It is a general object of the present invention to provide an improved electron gun for a television picture tube.

It is a more specific object of the present invention to provide an electron gun for a television picture tube, the gun having a low cost provision which is effective to suppress erosion of cathode coatings in the gun during its manufacture by preventing violent flow of gas over the cathodes as the tube is evacuated.

It is thus another object of the present invention to provide an electron gun for a television picture tube which increases the yield reliability and/or performance of the containing tube.

BRIEF DESCRIPTION OF THE DRAWINGS

The features of the present invention which are believed to be novel are set forth with particularity in the appended claims. The invention together with further objects and advantages thereof may best be understood by reference to the following description, taken in conjunction with the accompanying drawings in the several figures of which like reference numerals identify like elements, and in which:

DESCRIPTION OF THE PREFERRED EMBODIMENT

This invention pertains to an apparatus for suppressing erosion of the electron emissive coatings of the cathodes of an electron gun used in a television picture tube. The erosion is suppressed by preventing a violent flow of gas over the cathodes during evacuation of the tube during its manufacture.

Figure 1:
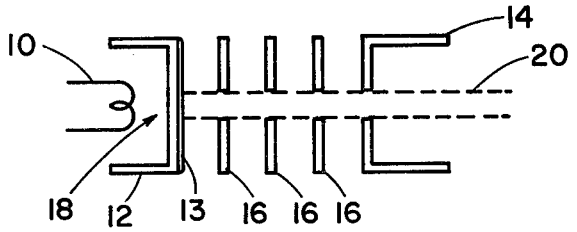
FIG. 1 is a schematic representation of an electron gun.
Figure 2:
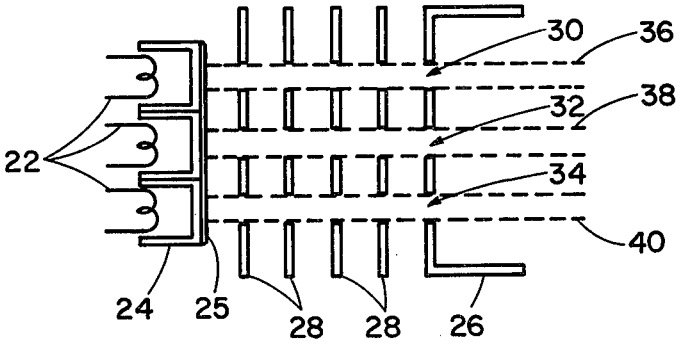
FIG. 2 is a schematic representation of an electron gun assembly used in a color television picture tube, the assembly comprising three distinct electron guns.

FIG. 1 schematically depicts a typical electron gun used in a television picture tube. The electron gun comprises at least one heater 10 and cathode 12, the cathode 12 having an electron emissive coating 13, and a forward element, such as a convergence or shield cup 14, with several electrodes 16 interspaced between the cathode 12 and the shield cup 14. The electrodes 16 and the shield cup 14 each have at least one aperture 18. These apertures 18 in the electrodes 16 and shield cup 14 are coaxial and define a beam passageway 20 for passing through the gun a stream of electrons emitted by the cathode 12 during operation of the tube. In an electron gun assembly for a color television picture tube (schematically depicted in FIG. 2), there are in actuality three electron guns. The electron gun assembly has three heaters 22 and cathodes 24, the cathodes 24 having electron emissive coatings 25, a shield cup 26 and a plurality of electrodes 28 interspaced between the three cathodes 24 and the shield cup 26. Each of the electrodes 28 and the shield cup 26 have three apertures 30, 32, 34. Arbitrarily, these apertures can be denoted first 30, second 32 and third 34 apertures which correspond to the red, blue and green electron guns. The apertures 30, 32, 34 in the electrodes 28 and shield cup 26 are coaxial and define three beam passageways 36, 38, 40 for passing through the gun assembly streams of electrons emitted by the three cathodes 24 during operation of the tube.

Figure 3:
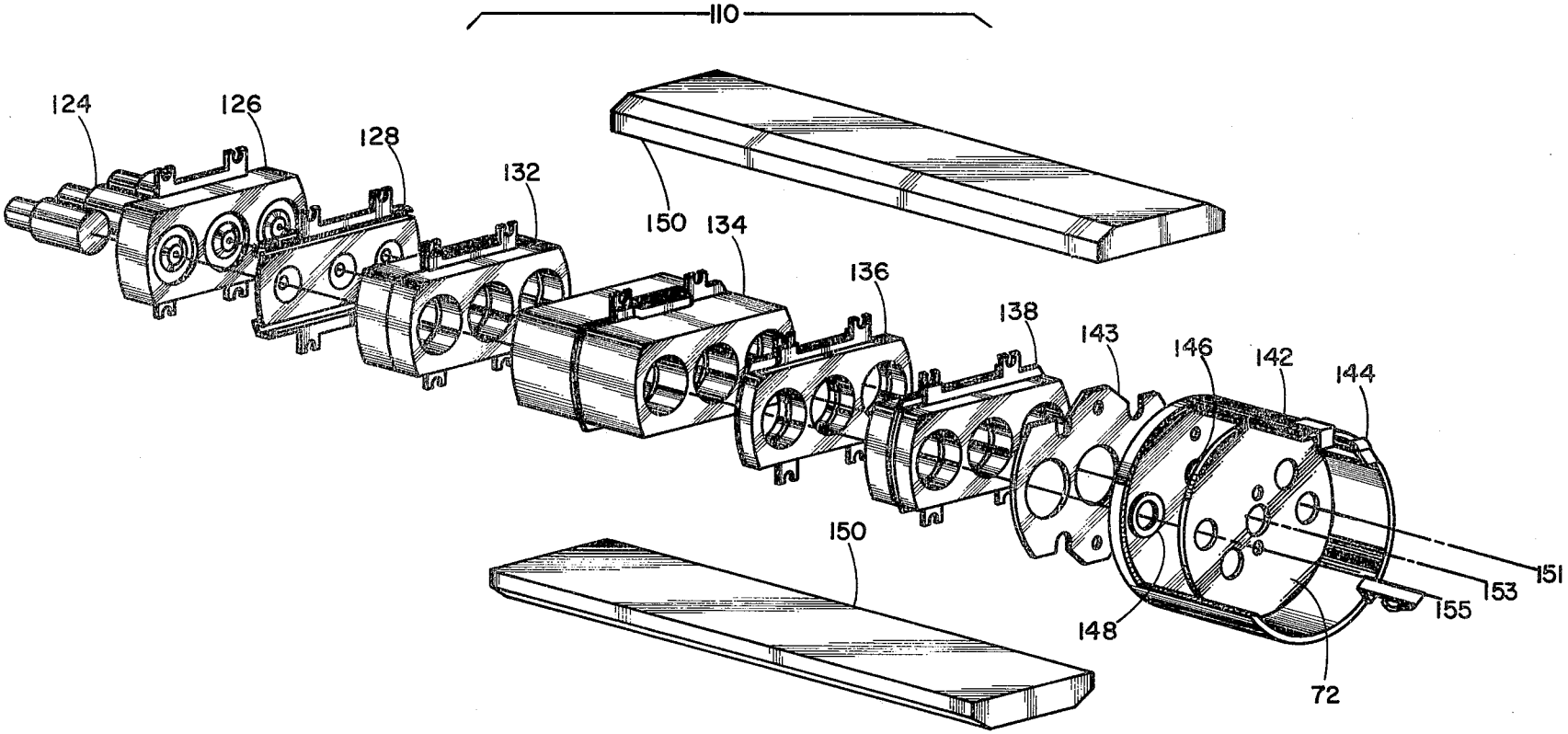
FIG. 3 is a perspective view of an in-line type electron gun for use in a color television picture tube.

More specifically, FIG. 3 shows an in-line type gun, generating three coplanar electron beams each of which is formed, shaped and directed to selectively energize phosphor elements located on the imaging screen in the expanded area at the opposite end of the cathode ray tube envelope (not shown).

The gun 110 has a tetrode section which generates three separate beam cross-overs (not shown ), one for each of three beams 151, 153 and 155 (red-associated, blue-associated and green-associated). The tetrode section is comprised of four parts: separate cathodes 124 for each beam, a common control electrode 126 ("G"), a common disc-type accelerating electrode 128 ("G2"), and a part of a common electrode 132 ("G3"); that is, the "lower end", or the end nearest the cathode.

Beam cross-overs are imaged on the screen of the cathode ray tube by respective main focus lens means. The main focus lens means for the three beams 151, 153 and 155 are unitized and constituted by the upper end section of common main focus electrode 132 and common main focus electrodes 134, 136 and 138. Each of these electrodes 132, 134, 136 and 138 is electrically isolated from the others and receives predetermined voltages from a power supply to form a single extended main focusing field. The collection of unitized common main focus electrodes 132, 134, 136 and 138 are termed the "main focus lens" of the gun 110. The main focus lens means is described and claimed in U.S. Pat. No. 3,995,194. The term "main focus lens means" refers to the focus lens structures employed to focus a single beam. The term "main focus electrode means" refers to a discrete individual focus electrode for a single beam, or an allotted portion of a unitized electrode common to other beams.

Further with reference to FIG. 3, the last in the series of elements that comprise electron beam gun 110 is shield cup 142. Shield cup 142 provides a mounting base for three contact springs 144 which center the forward end of the gun in the neck of the cathode ray tube. Also, by contact with an electrically conductive coating on the inside of the neck of the tube, which is maintained at screen voltage, contact springs 144 convey the screen voltage through shield cup 142 to electrode 138 of the main focus lens. Located within the cavity formed by the shield cup 142, and adjacent to the apertures from which the three electron beams 151, 153 and 155 emerge, are enhancer and shunt magnetic devices. Shield cup 142 is aligned and bonded to electrode 138 in precise registration by means of a carrier plate 143 which lies between the cup and electrode (described and claimed in copending application Ser. No. 649,630, filed Jan. 16, 1976). In the unitized in-line gun described in this disclosure, the common electrodes 126, 128, 132, 134, 136 and 138 have on each side thereof at least one pair of widely spaced, relatively narrow claws embedded at widely spaced points in a wide bead 150 (described and claimed in U.S. Pat. No. 4,032,811, issued Jun. 28, 1977).

As noted, except for three cathodes 124, the individual electrodes are "unitized"; that is, they each comprise one mechanical assembly having individual apertures for the three coplanar beams 151, 153 and 155. The gun electrodes are further characterized by having three effectively continuous, electrically shielding beam passageways extending completely through the electrodes, each passageway being formed by a contiguous axial succession of deep-drawn annular lips.

Figure 4:
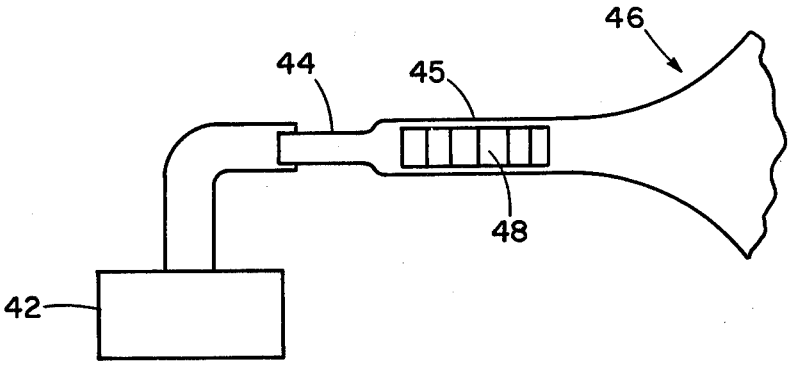
FIG. 4 is a schematic representation of the standard method of evacuatng a television picture tube during manufacture.

Whether the electron gun assembly contains one gun or three, the coaxial apertures in the electrodes and shield cup form beam passageways, and these beam passageways unavoidably form conduits for high velocity gas when the tube, especially a tube having a narrow neck, is evacuated during manufacture. During the manufacture of television picture tubes, after the tube is assembled, it is necessary to evacuate the tube of most air or gas which is in the tube (see FIG. 4). This is typically done by attaching a vacuum pump 42 to a tubulator 44 which is attached to a rear end of the neck 45 of a tube 46. When the tube 46 is evacuated, an electron gun 48 is already in position within the neck 45 of the tube 46. As the vacuum pump 42 removes the gas from the tube 46, the beam passageways in the gun 48 unavoidably form conduits for high velocity gas. Since the cathodes of the electron gun are necessarily positioned in the axis of the coaxial apertures of the gun, these beam passageways create a violent flow of gas over the cathodes.

It has been observed that during evacuation of the tube, the electron emissive coatings on the cathodes of the electron gun have been eroded. It is well known that the cathode coatings are sensitive to humidity in the atmosphere during evacuation of the tube and it is common practice to control the humidity within a narrow dew point window during evacuation. Typically the dew point is controlled between 40° F to 50° F. If the humidity is too high the cathode coating may be eroded by particles of moisture condensing on the cathode during evacuation. It is believed that the moisture particles freeze during the evacuation. This, coupled with their high velocity during evacuation in the violent flow of gas through the narrow neck of the tube, results in serious erosion of the cathodes. This theory has been tested by injecting particles of carbon into the tube before evacuation. After the tube was evacuated carbon particles were observed on the cathode coatings of the electron gun and thus it is believed that the above theory is correct, that particles of moisture due to the drop in pressure within the tube and due to the violent flow of gas over the cathodes cause erosion of the cathode coatings. By the present invention erosion of the cathode coatings is supressed by preventing a violent flow of gas over the cathodes.

In general terms this invention involves a novel electron gun having at least one cathode having an electron emissive coating, a forward element and a plurality of electrodes interspaced between the cathode and the forward element. The electrodes and forward element each have at least one aperture wherein the apertures in the electrodes and forward element are coaxial and define at least one beam passageway for passing through the gun a stream of electrons emitted by the cathode during operation. The beam passageway unavoidably forms a conduit for high velocity gas when the gun is located in a narrow neck of a television picture tube and the tube is evacuated of gas through a tubulator located at the rear end of the neck. The improvement in the electron gun comprises a gas influencing element for reducing and perturbing the high velocity gas flow in the conduit at least in the region of the cathode as the tube is evacuated to suppress erosion of the cathode coating by preventing a violent flow of gas over the cathode.

Figure 5A:
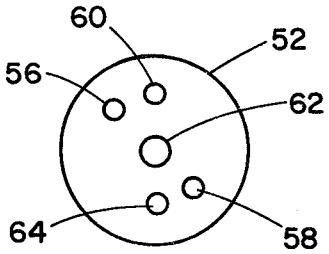
FIGS. 5–11 are schematic representations depicting various embodiments of the present invention.
Figure 5B:
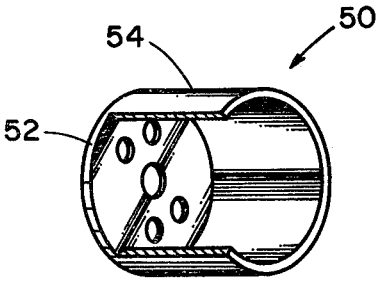

FIGS. 5A and 5B illustrate a preferred embodiment of the present invention. A gas influencing element comprises a bottom wall 52 of a shield cup 50, the bottom wall 52 having a pattern of auxiliary gas-perturbing openings 56 and 58. The shield cup 50 has a side wall 54 extending from the bottom wall 52. The auxiliary openings reduce and perturb the high velocity gas flow in the conduits the electron gun at least in the region of the cathodes as the tube is evacuated. The reduction and perturbation of the gas flow suppresses erosion of the cathodes by preventing a violent flow of gas over the cathodes. In a preferred embodiment the auxiliary openings 56 and 58 are similar in size to the apertures 60, 62 and 64 in the shield cup 50. The first auxiliary opening 56 is adjacent the first and second apertures 60, 62 and the second auxiliary opening 58 is adjacent the second and third apertures 62, 64. The first and second auxiliary openings 56, 58 are diametrically opposed about the second aperture 62.

Figure 6:
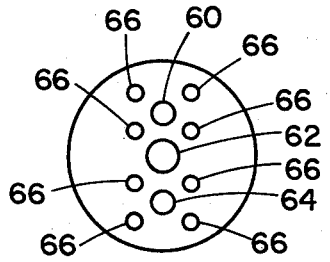
Figure 7:
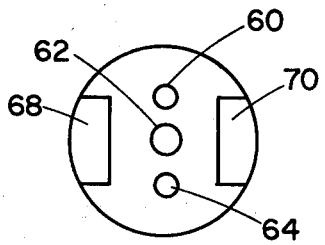
Figure 8:
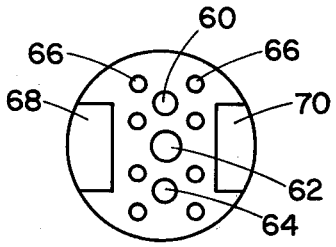

FIGS. 6, 7 and 8 illustrate alternative embodiments of th present invention. FIG. 6 shows a series of auxiliary gas-perturbing openings 66 on either side of the apertures 60, 62 and 64. FIG. 7 shows a air of substantially large openings 68 and 70 located on either side of the apertures 60, 62, 64. The FIG. 8 embodiment is a combination of the FIG. 6 embodiment and the FIG. 7 embodiment. All of these embodiments cause reduction and perturbation of the gas flow in the electron gun conduits as the tube is evacuated, but the reduction and perturbation of the gas flow varies in intensity with the type of hole pattern used, the preferred embodiment causing the greatest reduction and perturbation and therefore the greatest suppression of cathode coating erosion.

Figure 9A:
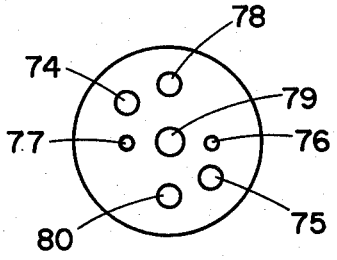
Figure 9B:
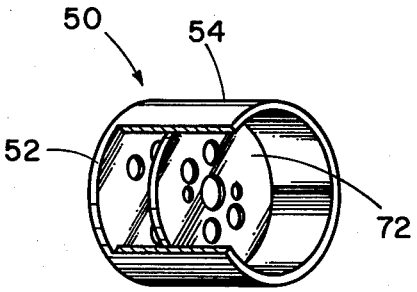

A second preferred embodiment has been used successfully in the unique type of electron gun disclosed in U.S. Pat. No. 3,995,194 (see FIGS. 9A and 9B and FIG. 3). In this embodiment the gas influencing element comprises a plate 72 having a pattern of auxiliary gas-perturbing openings 74–77. The plate 72 is located within the shield cup 50 a predetermined distance from the bottom wall 52 and attached to the side wall 54. The plate 72 has first, second and third aperture openings 78, 79 and 80. The aperture openings are in line with the first, second and third apertures 60, 62 and 64 in the bottom wall 52 of the shield cup 50, respectively. The first and second auxiliary openings 74 and 75 in the plate 72 are similar in size to the aperture openings 78, 79, 80. The first auxiliary opening 74 is adjacent the first and second aperture openings 78, 79 and the second auxiliary opening 75 is adjacent the second and third aperture openings 79 and 80. The first and second auxiliary openings 74, 75 are diametrically opposed about the second aperture opening 79. The third and fourth auxiliary openings 76, 77 in the plate 72 are smaller in size than the aperture openings 78, 79, 80. The third auxiliary opening 76 is adjacent the second auxiliary opening 75 and the second aperture opening 79 and the fourth auxiliary opening 77 is adjacent the first auxiliary opening 74 and the second aperture opening 79. The third and fourth auxiliary openings 76 and 77 are diametrically opposed about the second aperture opening 79.

It is believed that there is more than one factor which contributes to the suppression of the erosion of the cathode coatings. The perturbing of the gas flow in the region of the gas influencing element and the impedance of the gas flow by the gas infuencing element are believed to cause (1) a residual perturbing of the gas in the region of the cathode and (2) a reduction in the flow of gas over the cathode. The ratio of effectiveness in supressing the cathode coating erosion is not known.

Figure 10A:
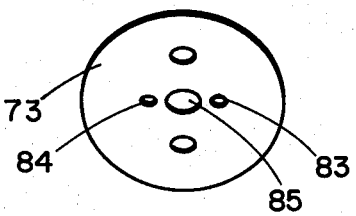
Figure 10B:
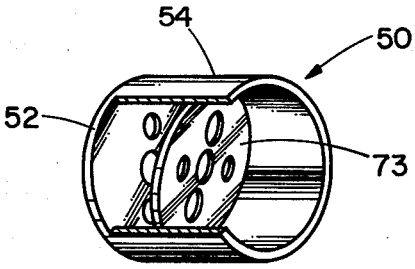

FIGS. 10A and 10B illustrate an alternative embodiment wherein the plate 73 is positioned at an angle of approximately 45 degrees to the bottom wall 52 of the shield cup 50. The plate comprises a pair of auxiliary gas-perturbing openings 83, 84 diametrically opposed about a center aperture opening 85.

Figure 11A:
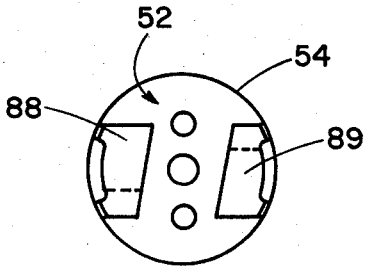
Figure 11B:
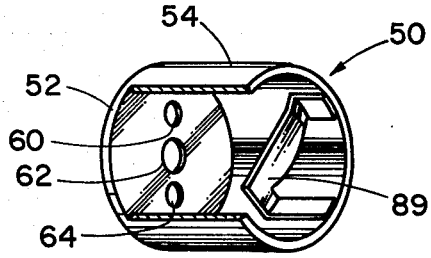

Another alternative embodiment of the present invention utilizes deflector means for redirecting and reducing the high velocity gas flow in the conduits at least in the region of the cathodes as the tube is evacuated. By redirecting and reducing the high velocity gas flow the erosion of the cathode coatings is suppressed by preventing a violent flow of gas over the cathodes. An embodiment of the deflector means is illustrated in FIGS. 11A and 11B in which the deflector means is located on the electron gun. In FIG. 11A and 11B the deflector means comprises a pair of fins 88 and 89. The fins 88 and 89 are attached to the side wall 54 of the shield cup 50 at an angle of approximately 45° to the bottom wall 52. The fins 88 and 89 extend into the interior of the shield cup 50, but do not cover the apertures 60, 62, 64 in the bottom wall 52 of the shield cup 50.

The invention is not limited to the particular details of construction of the device depicted and other modifications and applications are contemplated. For example, a means for perturbing the high velocity gas flow in the conduits may be attached to the internal glass surface of the television picture tube, either on the neck or flared portion of the tube. Fins may also be attached to other portions of the electron gun other than the shield cup. Certain other changes may be made in the above-described device without departing from the true spirit and scope of the invention herein involved. It is intended therefore that the subject matter in the above depiction shall be interpreted as illustrative and not in a limiting sense.

What is claimed is:

1. An electron gun having at least one cathode having an electron emissive coating, a forward element and a plurality of electrodes interspaced between said cathode and said forward element, said electrodes and forward element each having at least one aperture wherein said apertures in said electrodes and forward element are coaxial and define at least one beam passageway for passing through said gun a stream of electrons emitted by said cathode during operation, and also wherein said beam passageway unavoidably forms a conduit for high velocity gas when said gun is located in a narrow neck of a television picture tube and said tube is evacuated of gas through a tubulator located at the rear end of said neck, the improvement comprising a gas influencing element for reducing and perturbing said high velocity gas flow in said conduit at least in the region of said cathode as said tube is evacuated to suppress erosion of said cathode coating by preventing a violent flow of gas over said cathode.

2. The apparatus defined in claim 1 wherein said forward element is a shield cup and said gas influencing element comprises a bottom wall of said shield cup, said bottom wall having a pattern of auxiliary gas-perturbing openings.

3. The apparatus defined in claim 1 wherein said forward element is a shield cup having a bottom wall and a side wall extending therefrom and said gas influencing element comprises a plate having a pattern of auxiliary gas-perturbing openings, said plate being located within said shield cup a predetermined distance from said bottom end of said shield cup and attached to said side wall of said shield cup.

4. For use in a color television picture tube having a narrow neck wherein said neck has a front end joined with a flared portion of said tube and a rear end having an axially extending tubulator through which gas is evacuated from said tube after said tube is assembled, an electron gun having three cathodes adjacent said rear end of said neck, said cathodes having electron emissive coatings, a forward element adjacent said front end of said neck, and a plurality of electrodes interspaced between said cathodes and said foward element, said electrodes and forward element each having first, second and third apertures, wherein said first apertures are coaxial, said second apertures are coaxial and said third apertures are coaxial, said first, second and third coaxial apertures defining first, second and third beam passageways for passing through said gun three streams of electrons emitted by said cathodes during operation of said tube, said beam passageways unavoidably forming conduits for high velocity gas when said tube is evacuated, the improvement comprises a gas influencing element for reducing and perturbing said high velocity gas flow in said conduits at least in the region of said cathodes as said tube is evacuated to suppress erosion of said cathode coatings by preventing a violent flow of gas over said cathodes.

5. The apparatus defined in claim 4 wherein said forward element is a shield cup and said gas influencing element comprises a bottom wall of said shield cup, said bottom wall having a pattern of auxiliary gas-perturbing openings.

6. The apparatus defined in claim 5 wherein said second aperture lies between said first and third apertures of each of said electrodes and shield cup and the centers of each of said first, second and third apertures lie substantially on a straight line, and wherein said pattern of auxiliary openings in said bottom wall of said shield cup comprises first and second auxiliary openings, each of said auxiliary openings being similar in size to said apertures, said first auxiliary opening being adjacent said first and second apertures and said second auxiliary opening being adjacent said second and third apertures, said first and second auxiliary openings being diametrically opposed about said second aperture.

7. The apparatus defined in claim 4 wherein said forward element is a shield cup having a bottom wall and a side wall extending therefrom and said gas influencing element comprises a plate having three aperture openings for passing said three streams of electrons and a pattern of auxiliary gas-perturbing openings, said plate being located within said shield cup a predetermined distance from said bottom wall of said shield cup and attached to said side wall of said shield cup.

8. The apparatus defined in claim 7 wherein said plate is parallel to said bottom wall of said shield cup and wherein said first plate has first, second and third aperture openings, said aperture openings being aligned with said first, second and third apertures in said shield cup, respectively; said pattern of auxiliary gas-perturbing openings in said plate comprises first and second auxiliary openings in said plate, each of said first and second auxiliary openings being similar in size to said aperture openings, said first auxiliary opening being adjacent said first and second aperture openings and said second auxiliary opening being adjacent said second and third aperture openings, said first and second auxiliary openings being diametrically opposed about said second aperture opening; and third and fourth auxiliary openings in said plate, each of said third and fourth auxiliary openings being smaller in size than said aperture openings, said third auxiliary opening being adjacent said second auxiliary opening and said second aperture opening, and said fourth auxiliary opening being adjacent said first auxiliary opening and said second aperture opening, said third and fourth auxiliary openings being diametrically opposed about said second aperture opening.

9. For use in a color television picture tube having a narrow neck wherein said neck has a front end joined with a flared portion of said tube and a rear end having an axially extending tubulator through which gas is evacuated from said tube after said tube is assembled, and having an electron gun having three cathodes adjacent said rear end of said neck, said cathodes having electron emissive coatings, a forward element adjacent said front end of said neck, and a plurality of electrodes interspaced between said cathodes and said forward element, said electrodes and forward element each having first, second and third apertures, wherein said first apertures are coaxial, said second apertures are coaxial and said third apertures are coaxial, said first, second and third coaxial apertures defining first, second and third beam passageways for passing through said gun three streams of electrons emitted by said cathodes during operation of said tube, said beam passageways unavoidably forming conduits for high velocity gas when said tube is evacuated, the improvement comprising deflector means for redirecting and reducing said high velocity gas flow in said conduits at least in the region of said cathodes as said tube is evacuated to suppress erosion of said cathode coatings by preventing a violent flow of gas over said cathodes.

10. The apparatus defined in claim 9 wherein said deflector means is located on said electron gun.

11. The apparatus defined in claim 10 wherein said deflector means comprises at least one fin attached to said forward element of said electron gun.

12. For use in a color television picture tube having a narrow neck wherein said neck has a front end joined with a flared portion of said tube and a rear end having an axially extending tubulator through which gas is evacuated from said tube after said tube is assembled, an electron gun having three cathodes adjacent said rear end of said neck, said cathodes having electron emissive coatings, a shield cup, said shield cup being adjacent said front end of said neck, and a plurality of electrodes interspaced between said cathodes and said shield cup, said electrodes and said bottom wall of said shield cup each having first, second and third apertures, wherein said second aperture lies between said first and third apertures of each of said electrodes and shield cup and the centers of each of said first, second and third apertures lie substantially on a straight line, and wherein said first apertures are coaxial, said second apertures are coaxial and said third apertures are coaxial, said first, second and third coaxial apertures defining first, second and third beam passageways for passing through said gun streams of electrons emitted by said cathodes during operation of said tube, said beam passageways unavoidably forming conduits for high velocity gas when said tube is evacuated, the improvement comprising a bottom wall of said shield cup having a pattern of auxiliary gas-perturbing openings for reducing and perturbing said high velocity gas flow in said conduits at least in the region of said cathodes as said tube is evacuated to suppress erosion of said cathode coatings by preventing a violent flow of gas over said cathodes, said pattern of auxiliary openings comprising first and second auxiliary openings in said bottom wall of said shield cup, each of said auxiliary openings being similar in size to said apertures, said first auxiliary opening being adjacent said first and second apertures and said second auxiliary opening being adjacent said second and third apertures, said first and second auxiliary opening being diametrically opposed about said second aperture.

13. For use in a color television picture tube having a narrow neck wherein said neck has a front end joined with a flared portion of said tube and a rear end having an axially extending tubulator through which gas is evacuated from said tube after said tube is assembled, an electron gun having three cathodes adjacent said rear end of said neck, said cathodes having electron emissive coatings, a shield cup having a bottom wall and a side wall extending therefrom, said shield cup adjacent said front end of said neck, and a plurality of electrodes interspaced between said cathodes and said shield cup, said electrodes and shield cup each having first, second and third apertures, wherein said first apertures are coaxial, said second apertures are coaxial and said third apertures are coaxial, said first, second and third coaxial apertures defining first, second and third beam passageways for passing through said gun streams of electrons emitted by said cathodes during operation of said tube, said beam passageways unavoidably forming conduits for high velocity gas when said tube is evacuated, the improvement comprising: a plate having a pattern of auxiliary gas-perturbing openings for reducing and perturbing said high velocity gas flow in said conduits at least in the region of said cathodes as said tube is evacuated to suppress erosion of said cathode coatings by preventing a violent flow of gas over said cathodes, said plate being located within said shield cup a predetermined distance from said bottom end of said shield cup and attached to said side wall of said shield cup, said plate having first, second and third aperture openings, said aperture openings being aligned with said first, second and third apertures in said shield cup, respectively; said pattern of auxiliary openings in said plate comprising first and second auxiliary openings, each of said first and second auxiliary openings being similar in size to said aperture openings, said first auxiliary opening being adjacent said first and second aperture openings and said second auxiliary opening being adjacent said second and third aperture openings, said first and second auxiliary openings being diametrically opposed about said second aperture opening; and third and fourth auxiliary openings in said plate, each of said third and fourth auxiliary openings being smaller in size than said aperture openings, said third auxiliary opening being adjacent said second auxiliary opening and said second aperture opening, and said fourth auxiliary opening being adjacent said first auxiliary opening and said second aperture opening, said third and fourth auxiliary openings being diametrically opposed about said second aperture opening.

* * * * *